US006307316B1

(12) United States Patent
Holzer

(10) Patent No.: US 6,307,316 B1
(45) Date of Patent: Oct. 23, 2001

(54) FLUORESCENT LAMP WITH REPLACEABLE LIGHT ELEMENT

(76) Inventor: Walter Holzer, Drosteweg 19, D-88709 Meersburg (DE)

( * ) Notice: Subject to any disclaimer, the term of this patent is extended or adjusted under 35 U.S.C. 154(b) by 0 days.

(21) Appl. No.: 09/125,753

(22) PCT Filed: Jan. 22, 1997

(86) PCT No.: PCT/EP97/00276

§ 371 Date: Dec. 3, 1998

§ 102(e) Date: Dec. 3, 1998

(87) PCT Pub. No.: WO97/32453

PCT Pub. Date: Sep. 4, 1997

(30) Foreign Application Priority Data

Feb. 26, 1996 (DE) ..... 196 07 208

(51) Int. Cl.[7] ..... H01J 7/44

(52) U.S. Cl. ..... 313/493; 313/634; 315/57; 315/58

(58) Field of Search ..... 313/493, 331, 313/623, 634; 315/58, 57, 63, 56, 50, 71, 61, 62, 53

(56) References Cited

U.S. PATENT DOCUMENTS 5,128,590 * 7/1992 Holzer ..... 313/493 X
6,020,682 * 2/2000 Holzer ..... 313/493
6,054,806 * 4/2000 Holzer ..... 313/318.09 X

* cited by examiner

*Primary Examiner*—Ashok Patel
(74) *Attorney, Agent, or Firm*—Marshall, Gerstein & Borun

(57) ABSTRACT

The invention concerns a construction kit system for fluorescent lamps (1) with separate choke unit. Standard low-power modules which are cheap and easy to manufacture can in particular be plugged in any combinations into choke units fitted as compact lights or in lamp housings. A number of examples are given to show the new possibilities for constructing lighting systems. These fluorescent lamps each have a replaceable light element comprising at least one gas discharge vessel (1) with a base at one end as the light element and at least one choke unit (6) in the form of a separate unit fitted in a housing and capable of electrical connection via plug connectors (2) to the light element. The light element is designed as a standard low-power module with a glass tube diameter of the gas discharge vessel of no more than 13 mm, thus allowing it to be plugged into different housings individually or in groups.

4 Claims, 2 Drawing Sheets

FLUORESCENT LAMP WITH REPLACEABLE LIGHT ELEMENT

BACKGROUND OF THE INVENTION

There has been renewed interest in the development of fluorescent lamps in the last few years. Numerous new forms and models have come on the market, especially in the field of compact fluorescent bulbs which can be used as replacements for conventional incandescent bulbs in existing lamp assemblies.

Simultaneously with these developments in the field of fluorescent lamps, the use of halogen bulbs has increased enormously. The small size of halogen bulbs results in flexible possibilities for using such bulbs in a variety of applications and has made possible the creation of new lamp construction forms. Halogen lamps have become a construction kit element which makes it possible even for hobbyists to realize their own ideas of new lighting systems.

This possibility has been hitherto absent with respect to fluorescent lamps. The high production costs of fluorescent bulbs compel extreme automatization and prevent a flexible adaptation to wishes of the market.

SUMMARY OF THE INVENTION

The problem addressed by the present invention is to create also for fluorescent lamps a module system similar to a construction kit which makes it possible to form flexible variations for lights of every type.

According to the present invention this problem is solved by providing fluorescent lamps that consist of one or more one-side socketed gas discharge vessels or fluorescent bulbs as lighting elements, and with one or more choke devices constructed as separate units which can be connected with the lighting elements over plug connections, the lighting elements constructed as small standard modules having low light output and having a glass tube diameter of the fluorescent bulbs not over 13 mm, so that they are pluggable singly or in groups into different housings.

The basic idea lies in combining several low-power standard modules, instead of high power gas discharge vessels, which are complicated to manufacture.

The housings can be provided with connecting parts, for example with an Edison winding E27 or a bayonet socket B22, so that they can be used in an existing light body as replacements for conventional incandescent lamps.

For use in new light constructions, it is simpler to provide the housings or the choke devices present in them with electrical connectors specially adapted for this application, for example wire connectors. The use of a specially designed connector to supply current to the lamps not only avoids the costs for the contact-hazardous lamp holders E27, but also the installation measurements of the lamps are substantially reduced.

In view of the low output of the individual fluorescent bulbs, it is also possible to substantially reduce the expenditure for the requisite current-limiting choke devices and to provide, according to the invention, a separate choke device for each standard module. Insofar as is appropriate, certain component groups, for example the current supply, can be allocated in common for several connecting devices.

The design used to manufacture the pluggable standard modules should be as economical as possible. According to the invention, therefore, it is recommended that the pluggable connections of the gas discharge vessel be constructed as plug pins which are fused directly to both ends of the gas discharge vessel.

In order to better secure the bulbs or standard modules against dropping out of the lamp fixture or lamp housing, it is further recommended that arresting or locking means be provided to hold the bulbs in place. The arrangement of reflector surfaces, especially with lamps with only one U-shaped gas discharge vessel, improves not only light distribution but can also serve simultaneously as a support for the individual standard light modules after it is plugged into the housing.

In instances where several fluorescent lamps or standard modules are employed, a special advantage of the invention lies in the fact that if one module fails or drops-out, the lamp assembly is capable of continued operation, and later only the faulty module has to be replaced.

If so desired, it is also possible to exchange modules of different form and color in a given lamp without high costs.

BRIEF DESCRIPTION OF THE DRAWINGS

For the better understanding of the concept of the invention reference is made to the following figures.

Figures 17, 18, 19, 20, 21, 22, 23, 24:
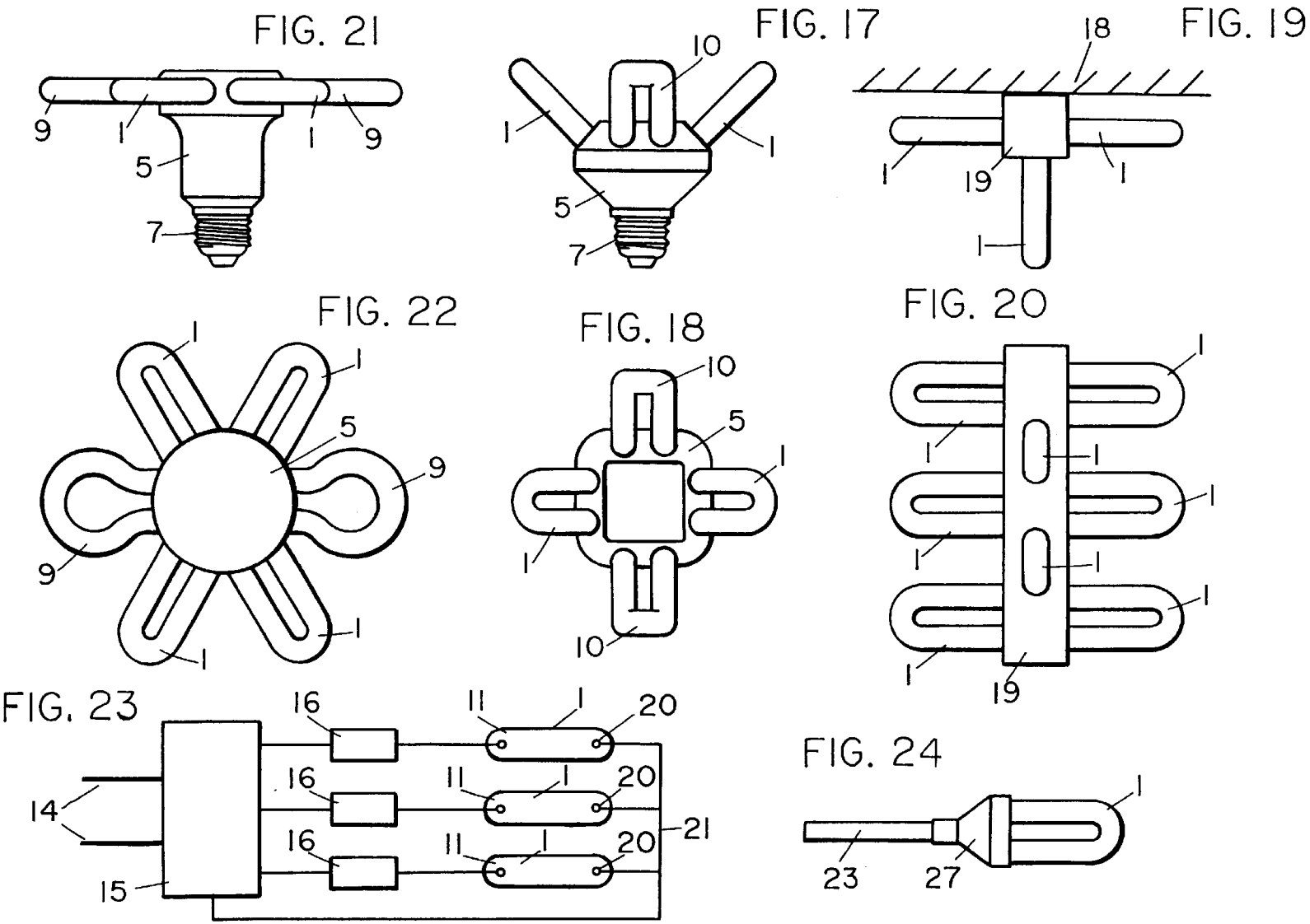
FIGS. 17 and 18, (also shown respectively as 21 and 22) present further examples of compact fluorescent lamps such as were not producible with the technologies hitherto used.

Also the example of a light band, in FIGS. 19 and 20, schematically shows the new possibilities using standard modules in accordance with the invention;

FIG. 23 is a schematic example of a choke device for use with three standard modules; and FIG. 24 is a schematic view of a component for lighting which uses a standard module according to the invention.

DETAILED DESCRIPTION OF THE INVENTION

The following thorough description of the examples according to the invention is in no way to be regarded as limiting, since many details according to the invention can be combined and varied.

FIGS. 1 to 10 show, first of all, different variations of standard modules according to the invention. Numerous combination possibilities are yielded through the fact that four basic elements can be changed, namely:

the form of the gas discharge vessel (1), the type of electrical contacts, the form of the electrodes, the form of the arresting means.

Figures 1, 2, 3, 4, 5, 6, 7, 8, 9, 10, 11, 12, 13, 14, 15, 16:
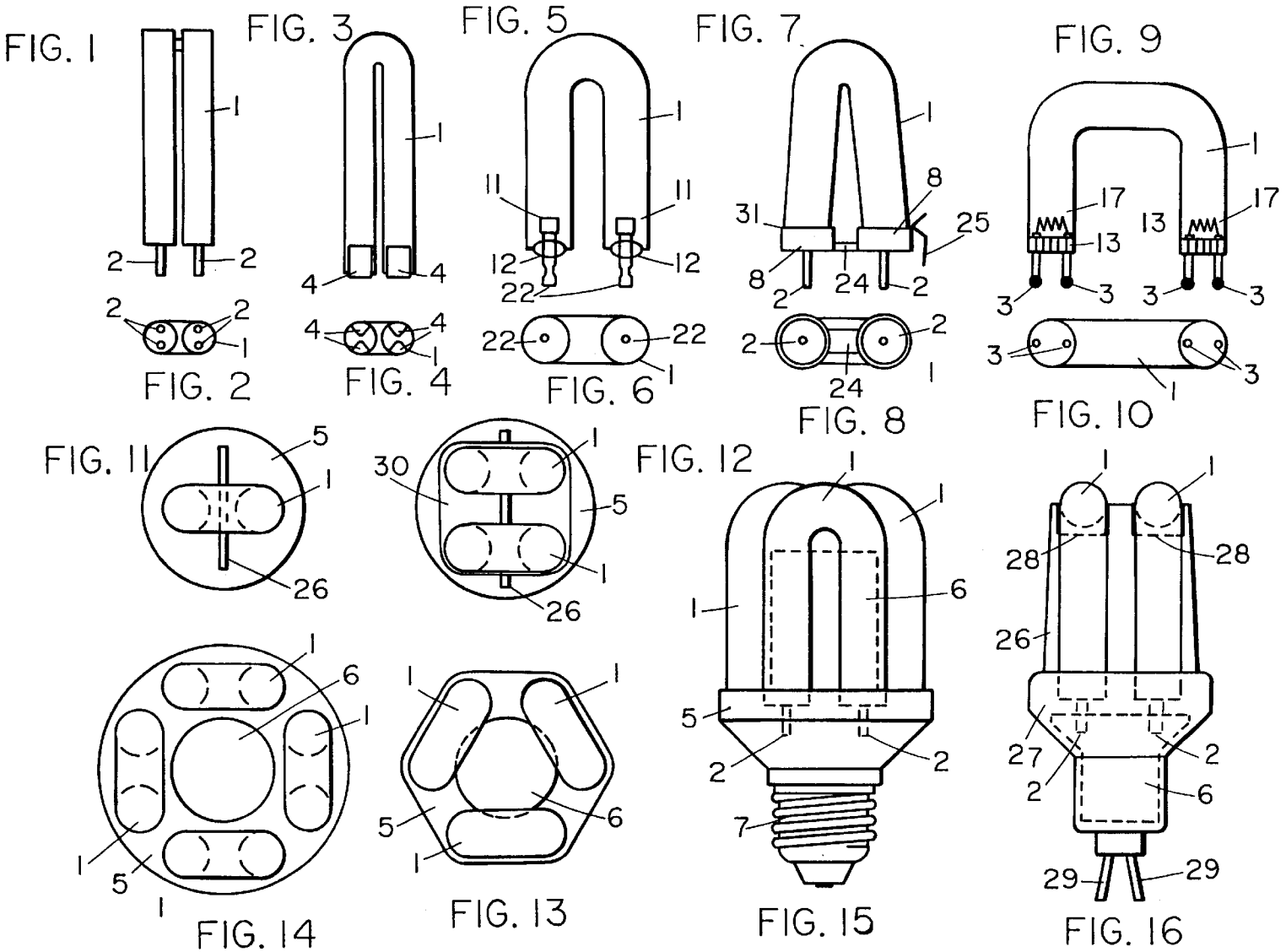
FIGS. 1 to 10 show five different examples of standard modules according to the present invention.
FIGS. 11 to 14 show axial plan views of fluorescent lamps or housings with one, two, three and four plugged-in standard modules or fluorescent bulbs.
FIG. 15 represents a compact lamp with three plugged-in standard modules, corresponding to the representation in FIG. 13.
FIG. 16 shows schematically a lamp according to the invention with two standard modules plugged into a housing which contains the choke devices and connecting possibilities for mains feed lines.

FIG. 1 shows a gas discharge vessel or flourescent bulb (1) such as is produced at present mainly by PHILIPS, consisting of two straight glass tubes which are joined at the upper end according to the "Hot Kiss" process. The smooth plug pins (2) and their arrangement are represented in FIG. 2.

FIG. 3 shows the form, in most widespread use today, of a gas discharge vessel (1) bent in U-form with very small spacing of the glass tube halves, such as are necessary for the construction of gas discharge vessels with relatively high capacity. As example of a pluggable contact means there are provided contact surfaces (4) the arrangement of which is to be seen in FIG. 4.

FIG. 5 likewise shows a U-shaped gas discharge vessel, having a greater radii of bending, which substantially facilitate the manufacture of such bending parts. In this example the plug pins (22) are fused-in with constrictions directly at the ends of the gas discharge vessel (1) by means of pen-feet (12). The cold cathodes (11) provided in this example require only one plug pin (22), so that FIG. 6 represents an extremely simple and economical arrangement of this invention.

FIG. 7 shows as a further example a V-shaped gas discharge vessel (1) with smooth plug pins (2) which are fastened in caps 8) and fastened with these to the ends of the gas discharge vessel (1). In such an arrangement the stability of the (24). The pocketing or fixing-in-place of the standard module could be realized, for example, by a stop spring (25) which snaps into place on the upper edge (31) of a cap (8). Such a stop spring could, of course, also engage on the crosspiece (24) or another profiling of the caps (8), in which case of course it is fastened to the housing in which the module is plugged. FIG. 8 shows the view in the direction of the pins (2) and the stable construction of this variant.

FIGS. 9 and 10 show another example of a flat-building gas discharge vessel (1) with greater spacing of the ends of bulb (1) which are provided with heated electrodes (17), in which the plug pins are fused with rest means (3) directly in a squeeze-foot (13) of the gas discharge vessel (1). As can be seen in FIG. 10, in this example the four plug pins are provided with socket means (3) and arranged in a line. The result is that the production tolerances of the glass parts need be maintained less critically, even if the springy counter-contacts are aligned in the same direction.

FIGS. 11 to 13 make evident the immense advantages of the construction of a fluorescent lamp according to the invention. With one and the same standard module there can be constructed a simple execution of the invention—a bulb (1) having a relatively low light output—as represented in FIG. 11—as well as lamps with two vessels or modules (FIG. 12), three modules (FIG. 13) and four modules, as in FIG. 14.

In FIG. 11 there is also to be perceived a support (26) which is mounted on the housing (5). A similar support (26) is shown also in FIG. 12 for two gas discharge vessels (11). The function of supports (26) can best be recognized in FIG. 16, where in a side view there are recognizable fork-shaped guides (28) which have the function of securing the gas discharge vessels (1) against lateral movement after the plugging-in of the standard modules.

The depression (30) in FIG. 12 has the function of avoiding any danger of contact of the pins (2) while plugging-in the modules, a safety feature which is lacking in conventional Edison sockets (e.g., FIG. 15 at (7)).

In FIG. 13 there can be perceived a further advantage of a standard module with greater pin spacing according to FIG. 5 or FIG. 7. Hitherto the close bending of the U-shaped gas discharge vessels according to FIG. 1 or 3 did not make it possible to utilize the interior space between the gas discharge vessels, in order, for example, to be able to accommodate in a space-saving way a choke device (6) or at least parts thereof The same holds also with superstructures with four standard modules, as represented in FIG. 14. The advantage of such an arrangement is clearly apparent from the representation in FIG. 15. Here it can be seen that the housing (5) can be constructed substantially shorter, since at least parts of the choke device (6) are accommodated centrally between the individual modules. In FIG. 15 also the housing of a compact lamp is represented, i.e. a lamp which can be attached to a connecting part (7)—in this case provided with an Edison winding E27—and screwed into a usual-type incandescent lamp socket.

As distinguished from the embodiment of FIG. 15, which is designed for use with conventional lamp sockets, for new constructions of illuminating bodies, a solution according to FIG. 16 is proposed. In this case, the socket housing (27), or the choke device (6) accommodated in it, is provided with connecting means, for example terminals, so that the connecting wires (29) can be connected directly with the choke device (6). Therewith there is eliminated the use of non-contact-safe socket E27, which has led to numerous, accidents, some of them fatal ones. With the introduction of a socket such as the one according to the invention it is possible not only to save costs, but also to obviate a dangerous component.

The use of standard modules according to the invention also makes possible lamp constructions which were not feasible according to technologies hitherto employed.

FIGS. 17 and 18 show such a compact lamp with connecting part (7), again an Edison winding E27, which, of course, can also be replaced by a bayonet socket or other standardized connecting parts. The gas discharge vessels (1) are obliquely arranged in the housing (5) in this example, and they give a substantially better light distribution in the axial direction of the lamp than is attainable with the compact lamps of hitherto. FIG. 18 shows an axial view of the lamp of FIG. 17. Here there is represented the possibility of utilizing bulbs or gas discharge vessels (1) of differing types, for example to the gas discharge vessels (10) shown with angularly bent glass tubes.

The compact lamp as represented in FIG. 21 is distinguished by flat light radiation such as is often desired for the aesthetic arrangement of rooms, but hitherto could not be supplied. The axial representation of the same lamp in FIG. 22 shows the expedient and elegant formation of such a lamp, which can be further enhanced by the use of special bulbs or modules (9) which have circular bendings in conjunction with arcuate bulbs (1).

The possibilities for forming gas discharge vessels (1) having difference geometries are not exhausted by the examples of the gas discharge vessels (9) or (10). For a creative formation of the glass bending parts according to the invention, the gate is open, since the necessity of having to join glass parts with one another in "Hot Kiss" lamps is eliminated by the use of a plurality of smaller fluorescent bulbs (1).

Accordingly, a light strip according to FIGS. 19 and 20 is possible, in which individual modules can be arrayed linearly next to one another. Practically, the number of gas discharge vessels (1) which can be plugged into a housing (19) is not limited. Light strips built up in this manner can be fastened, for example, to a ceiling (18), as shown in FIG. 19. Whether there are used here only the standard modules lying parallel to the ceiling (18), or whether there are possibly provided in the ceiling edges an angularly arranged solution of standard modules, depends merely on the taste of the customer.

The construction of chandeliers by means of standard modules is favored by a construction such as represented in FIG. 24. Here the gas discharge vessel (1) as standard module is inserted into a socket housing (27) on the end of which the usual 10 mm tubes (23) are installed, as they are used in the construction of illumination bodies. With such construction elements that make use of standard modules there is yielded in actual fact a construction kit system which opens up new horizons for lighting architects and designers of lighting system.

Although the proposal of the invention to replace, for example, an 18 watt fluorescent lamp with three standard modules of 6 watts appears more expensive, on exact analysis one comes to the following result.

The fully automatic manufacture of a much larger number of cheaply producible standard modules reduces the investment costs and piece costs mightily—finally one needs, for example instead of one 18 watt lamp, three modules of 6 watts, but with lower total costs.

Moreover, the advantages of an economical manufacture of this type of bulb, savings in stocking and in service, higher operating security, the eliminated danger of contact between voltage-conducting parts, and lower price, speak in favor of the new module system.

Fluorescent lamps of low capacity can be operated, for example, with simple capacitor choke devices, which cost less than an electronic 18 watt connecting device, especially when it can be constructed according to FIG. 23 in such manner that a common current supply (15) and three current-limiting means (16) which are coupled on the outlet side supply the gas discharge vessels (1). In particular the use of cold cathodes (11) and (20) simplify such a circuit. The cold cathodes (20), moreover, can be connected by a common return line (21) with the current supply (15), which is connected to the mains (14).

Although it has always been conceptually possible to develop gas discharge lamps of low capacity as modules and to use several of them as replacement for fluorescent lamps of greater capacity hereto for taken advantage of this opportunity at least in the form here represented. The new module construction kit opens up completely new possibilities. Architects and light manufacturers are freer in their possibilities of execution, the solution to lighting problems is facilitated, stimuli for do-it-yourself hobbyists are provided and altogether it is possible to expect, as a synergy effect, that the willingness to save energy will be increased by the use of inexpensive module fluorescent lamps.

What is claimed is:

1. A lighting system comprising:

first and second gas discharge vessels, each of said discharge vessels having at least one electrical contact pin extending vertically from each end thereof;

a holder for said gas discharge vessels, said holder containing a first socket for removably mounting said first gas discharge vessel, and a second socket for removably mounting said second gas discharge vessel;

a plurality of recessed electrical contacts in each of said sockets, said recessed contacts adapted to mate with the electrical contact pins of said gas discharge vessels;

first and second current limiting devices in said holder, an output side of said first current limiting device electrically connected to a recessed electrical contact in said first socket, and an output side of said second current limiting device electrically connected to a recessed electrical contact in said second socket;

a common power supply, said power supply having an input portion which is connected to a source of mains power, and an output portion having a plurality of electrical outlets;

a first supply line connecting a first outlet of said power supply to said first current limiting device, and a second supply line connecting a second outlet of said power supply to said second current limiting device; and a common electrical outlet line connecting said power supply output portion with a recessed electrical contact in said first socket and a recessed electrical contact in said second socket.

2. The lighting system of claim 1 wherein said common power supply is mounted in said holder.

3. The lighting system of claim 1 wherein said holder includes a base portion comprising a screw-type Edison winding E27.

4. The lighting system of claim 1 further including:

a third gas discharge vessel having at least one vertically-extending contact pin at each end of the vessel;

a third socket mounted in said holder for removably mounting said third discharge vessel;

a third current limiting device in said holder, said third device having its output side electrically connected to a recessed pin in said third socket;

a third supply line connecting a third outlet of said power supply to said third current limiting device; and said common electrical outlet line of the power supply electrically connected to a recessed pin in said third socket.

* * * * *